US009181798B2

(12) United States Patent
Palaghita et al.

(10) Patent No.: US 9,181,798 B2
(45) Date of Patent: Nov. 10, 2015

(54) REMOVABLE MODULAR ANTENNA ASSEMBLY FOR DOWNHOLE APPLICATIONS

(75) Inventors: Tudor Palaghita, Houston, TX (US); Cory James, Houston, TX (US); Fernando Garcia-Osuna, Sugar Land, TX (US); Frank Espinosa, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 823 days.

(21) Appl. No.: 13/433,836

(22) Filed: Mar. 29, 2012

(65) Prior Publication Data

US 2013/0255966 A1 Oct. 3, 2013

(51) Int. Cl.
*E21B 47/12* (2012.01)
*E21B 17/02* (2006.01)

(52) U.S. Cl.
CPC ..... *E21B 47/122* (2013.01); *E21B 17/028* (2013.01)

(58) Field of Classification Search
CPC ..... E21B 47/12; E21B 47/122; E21B 17/028; E21B 43/10; E21B 43/103; E21B 43/106; H01Q 1/04; G01V 3/30
See application file for complete search history.

(56) References Cited

U.S. PATENT DOCUMENTS

| | | | | |
|---|---|---|---|---|
| 4,536,714 | A | 8/1985 | Clark | |
| 4,800,385 | A | 1/1989 | Yamazaki | |
| 4,928,088 | A | 5/1990 | Jorion et al. | |
| 5,138,263 | A | 8/1992 | Towle | |
| 5,235,285 | A | 8/1993 | Clark et al. | |
| 5,491,488 | A | 2/1996 | Wu | |
| 5,661,402 | A * | 8/1997 | Chesnutt et al. | 324/338 |
| 5,753,812 | A | 5/1998 | Aron et al. | |
| 6,362,619 | B2 | 3/2002 | Prammer et al. | |
| 6,429,653 | B1 | 8/2002 | Kruspe et al. | |
| 6,583,621 | B2 | 6/2003 | Prammer et al. | |
| 6,766,854 | B2 | 7/2004 | Ciglenec et al. | |
| 6,788,263 | B2 | 9/2004 | Clark et al. | |
| 6,825,659 | B2 | 11/2004 | Prammer et al. | |
| 6,856,255 | B2 | 2/2005 | Chalitsios et al. | |

(Continued)

FOREIGN PATENT DOCUMENTS

| | | |
|---|---|---|
| RU | 45458 U1 | 5/2005 |
| SU | 947407 | 7/1982 |

OTHER PUBLICATIONS

International Search Report and Written Opinion of PCT Application No. PCT/US2013/048117 dated Oct. 2, 2013.

(Continued)

*Primary Examiner* — Nicole Coy
*Assistant Examiner* — Kristyn Hall
(74) *Attorney, Agent, or Firm* — John Vereb

(57) ABSTRACT

A wellbore apparatus may include first and second tubular members joined together in end-to-end relation, the first tubular member having a reduced outer diameter end portion. The wellbore apparatus may further include a removable modular antenna assembly comprising a cylindrical dielectric housing removably positioned on the reduced outer diameter end portion of the first tubular member, at least one antenna coil carried by the cylindrical dielectric housing, and a first electrical connector coupled to the at least one antenna coil. The wellbore apparatus may also include resistivity processing circuitry coupled to the first electrical connector to determine an electrical resistivity of a wellbore based upon the at least one antenna coil.

20 Claims, 4 Drawing Sheets

(56) References Cited

U.S. PATENT DOCUMENTS

| | | | |
|---|---|---|---|
| 7,140,434 | B2 | 11/2006 | Chouzenoux et al. |
| 7,301,429 | B1 | 11/2007 | Hall |
| 7,364,007 | B2 | 4/2008 | Garcia-Osuna et al. |
| 7,436,183 | B2 | 10/2008 | Clark |
| 7,619,540 | B2 | 11/2009 | Bonner et al. |
| 7,663,372 | B2 | 2/2010 | Signorelli et al. |
| 7,786,733 | B2 | 8/2010 | Seydoux et al. |
| 7,812,609 | B2 | 10/2010 | Martinez et al. |
| 2002/0101242 | A1 | 8/2002 | Bittar |
| 2005/0218898 | A1 | 10/2005 | Fredette et al. |
| 2006/0254767 | A1 | 11/2006 | Pabon et al. |
| 2008/0224707 | A1 | 9/2008 | Wisler et al. |
| 2009/0032303 | A1* | 2/2009 | Johnson ..... 175/40 |
| 2009/0179648 | A1 | 7/2009 | Fredette et al. |
| 2010/0251496 | A1* | 10/2010 | Vinci et al. ..... 15/104.05 |
| 2011/0316542 | A1 | 12/2011 | Frey et al. |

OTHER PUBLICATIONS

International Search Report and Written Opinion for International Application No. PCT/US2013/034093 dated Jul. 18, 2013.

* cited by examiner

REMOVABLE MODULAR ANTENNA ASSEMBLY FOR DOWNHOLE APPLICATIONS

TECHNICAL FIELD

This disclosure relates generally to antennas, such as those used in the well-logging applications, and related systems and methods.

BACKGROUND

Resistivity logging tools are used to measure the resistivities of earth formations surrounding a borehole, such as in a hydrocarbon (e.g., oil, natural gas, etc.) well. One approach for performing resistivity measurements is by lowering a wireline-conveyed logging device into a wellbore after the wellbore is drilled. Another approach is to make such measurements while the well is being drilled, which is referred to as logging-while-drilling (LWD) or measurement-while-drilling (MWD). LWD or MWD techniques may allow corrective actions to be taken during the drilling processes if desired. For example, wellbore information if available in real time may be used to make adjustments to mud weights to prevent formation damage and to improve well stability. In addition, real time formation log data may be used to direct a drill bit to the desired direction (i.e., geosteering).

Generally speaking, there are two types of LWD tools for measuring formation resistivity, namely lateral tools and induction or propagation tools. Each of these tools relies on an electromagnetic (EM) measurement principle. A lateral tool may use one or more antennas or electrodes to inject low-frequency transverse magnetic fields into the formations to determine borehole and formation responses by measuring the current flow through the formations to the receivers. Lateral resistivity tools are generally responsive to azimuthal variations in formation resistivities around the borehole.

Propagation-type tools emit high-frequency electric fields into the formation to determine borehole and formation responses by measuring voltages induced in the receivers or by measuring difference responses between a pair of receivers or between the transmitter and the receiver. For example, for a propagation tool, incoming signal phases and amplitudes may be measured at each of several receivers with respect to the phases and amplitudes of the signals used to drive the transmitter. Induction-type transmitters generate magnetic fields that induce currents to flow in the formations. These currents generate secondary magnetic fields that are measured as induced voltages in receiver antennas disposed at a distance from the transmitter antenna.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A wellbore apparatus is provided herein which may include first and second tubular members joined together in end-to-end relation, the first tubular member having a reduced outer diameter end portion. The wellbore apparatus may further include a removable modular antenna assembly including a cylindrical dielectric housing removably positioned on the reduced outer diameter end portion of the first tubular member, at least one antenna coil carried by the cylindrical dielectric housing, and a first electrical connector coupled to the at least one antenna coil. The wellbore apparatus may also include resistivity processing circuitry coupled to the first electrical connector to determine an electrical resistivity of a wellbore based upon the at least one antenna coil.

A related method for making a wellbore apparatus may include providing first and second tubular members to be joined together in end-to-end relation, with the first tubular member including a reduced outer diameter end portion, and removably positioning a cylindrical dielectric housing of a removable modular antenna assembly on the reduced outer diameter end portion of the first tubular member. The removable modular antenna assembly may include at least one antenna coil carried by the cylindrical dielectric housing, and a first electrical connector coupled to the at least one antenna coil. The method may also include coupling the first electrical connector to resistivity processing circuitry, and joining the first and second tubular members together in end-to-end relation with the removable modular antenna assembly carried by the reduced outer diameter end portion of the first tubular member.

DETAILED DESCRIPTION

The present description is made with reference to the accompanying drawings, in which example embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements in different embodiments.

Figure 1:
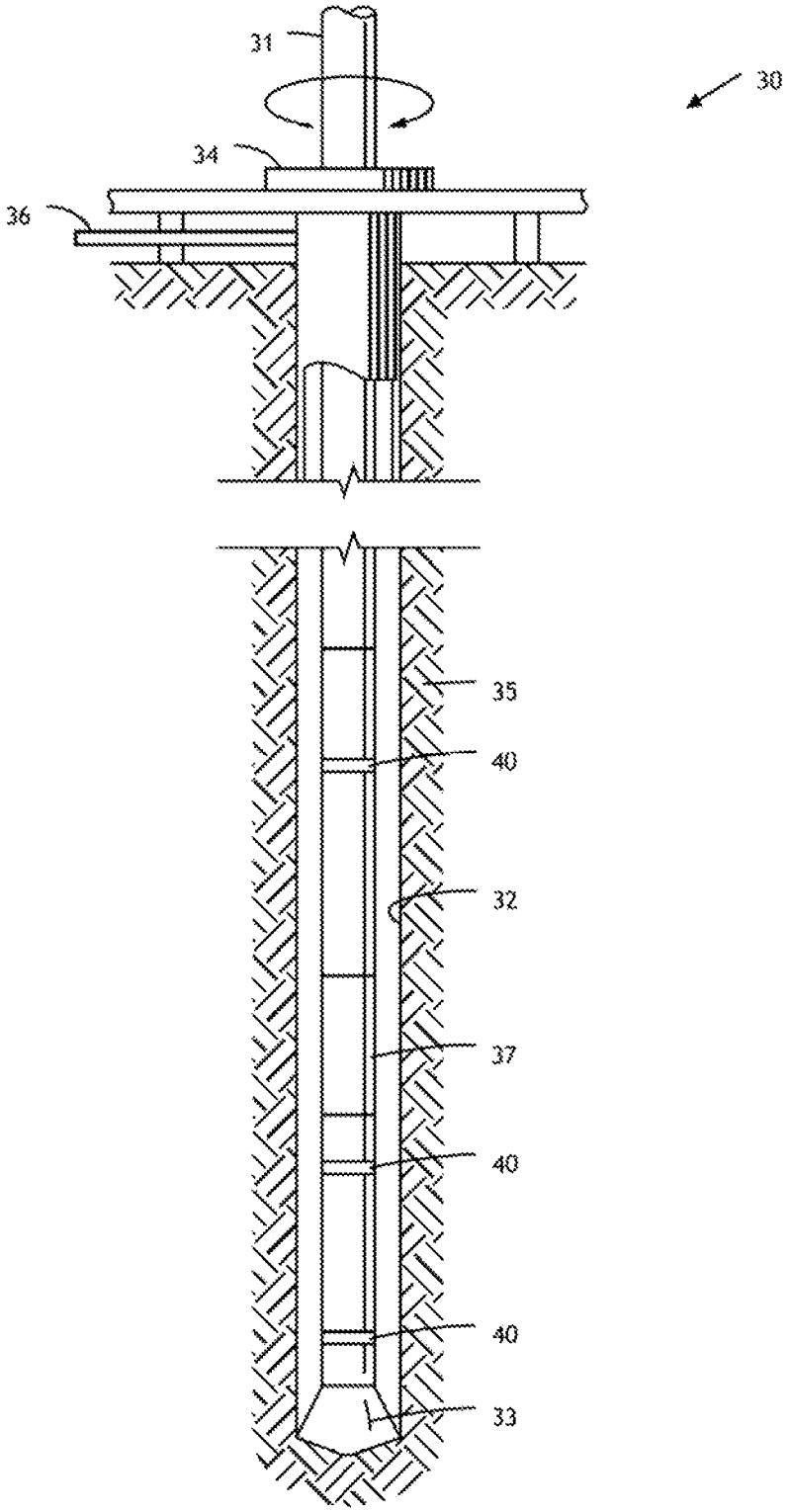
FIG. 1 is a schematic diagram of an LWD/MWD system including removable modular antenna assemblies in accordance with an example embodiment.

Referring initially to FIG. 1, a logging-while-drilling (LWD) or measurement-while-drilling (MWD) system 30 is first described. A drill string 31 is suspended within a borehole 32 with a drill bit 33 attached at the lower end. The drill string 31 and attached drill bit 33 are rotated by a rotating table 34 while being lowered into the well, although other approaches such as a top drive may be used instead of the rotating table. This causes the drill bit 33 to penetrate the geological formation 35. As the drill bit 33 penetrates the formation 35, drilling fluid or "mud" is pumped down through a bore of the drill string 31 (which may be a central bore, offset bore, or annular bore, for example) to lubricate the drill bit 33 and to carry cuttings from the bottom of the hole to the surface via the borehole 32 and mud flow line 36. Located behind drill bit 33 in the drill string 31 (i.e., vertically above the drill bit in FIG. 1) are sections of LWD drill collar tubulars 37, which may include a plurality of removable modular antenna assemblies 40 positioned between adjacent drill collar tubulars. The removable modular antenna assemblies 40 are used to measure the resistivity of the formation 32 as it is penetrated by the drill bit 33. It should be noted that the removable modular antenna assemblies 40, which will be discussed further below, may also be used in a wireline measurement system as well.

Figure 2:
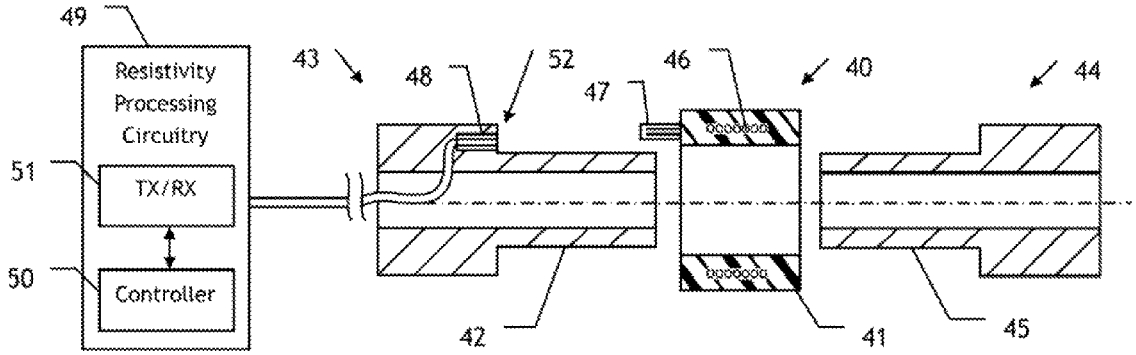
FIG. 2 is a schematic cross-sectional diagram of a removable modular antenna assembly and associated tubular members of FIG. 1 in accordance with a first example embodiment.
Figure 3:
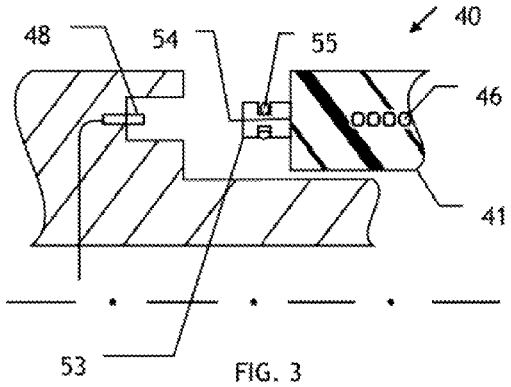
FIG. 3 is a schematic cross-sectional diagram of a portion of the removable modular antenna assembly and associated tubular member of FIG. 2 showing further details of the electrical connectors thereof.

Referring more particularly to FIGS. 2 and 3, a first embodiment of the removable modular antenna assembly 40 is now described. By way of background, an antenna for downhole use may includes one or more coils enclosed in an insulator material. The insulator material may be built in a recess of a downhole tubular (e.g. tool housing, collar, etc.), and permanently installed on the tool. However, the removable modular antenna assembly 40 illustratively includes a cylindrical dielectric housing 41 that is removably positioned on a reduced outer diameter end portion 42 of a first tubular member 43. The first tubular member 43 may then be joined together in an end-to-end relation with a second tubular member 44, with the removable modular antenna assembly 40 therebetween, as seen in FIG. 2. The second tubular member 44 also illustratively includes a reduced outer diameter end portion 45 in the present example, although in other embodiments it does not have to have a reduced outer diameter portion.

The removable modular antenna assembly 40 further illustratively includes one or more antenna coils 46 carried by the cylindrical dielectric housing 41, and a first electrical connector 47 coupled to the antenna coil(s). A second electrical connector 48 is carried by the first tubular member 43 and coupled with resistivity processing circuitry 49. The second electrical connector 48 mates with the first electrical connector 47 to thereby provide an electrical connection between the antenna coil 46 and the resistivity processing circuitry 49, which determines an electrical resistivity of a wellbore based upon the antenna coil. The resistivity processing circuitry illustratively includes a controller and a transmitter and/or receiver 51 coupled thereto. As noted above, multiple antenna assemblies 40 may be spaced apart along the drill string 31 to transmit and receive signals to and from the geological formation 35. As such, the controller 50 may interface with multiple transmitters and receivers for respective antenna assemblies 40. Transmitters and receivers may also be coupled to multiple antenna assemblies 40 (i.e., shared), and a given antenna assembly may be used to alternate between transmitting and receiving in some embodiments.

The controller 50 may be carried on the drill string 31 in the tool section behind the drill bit 33 in an electronic chassis. The controller 50 may collect resistivity measurement data and store it for later retrieval (such as when the drill string 31 is removed from the borehole 32), or it may communicate the resistivity measurement data up to a well logging control center outside of the well via telemetry or a wired connection. The controller 50 may first process the measured values to make resistivity determinations, or it may collect raw measurement data for later processing.

In the example illustrated in FIGS. 2 and 3, when the cylindrical dielectric housing 41 slides over the reduced outer diameter end portion 42 of the first tubular member 43, the first electrical connector 47, which is a male connector in the illustrated example, plugs into the second electrical connector 48, which is a female connector in this example. It should be noted, however, that the first electrical connector 47 may be a female connector and the second electrical connector 48 may be a male connector in some embodiments, or other suitable types of connector arrangements may be used.

In the illustrated example, the reduced outer diameter end portion 42 of the first tubular member 43 defines a shoulder 52 with adjacent portions of the first tubular member, and the second electrical connector 48 is carried by the shoulder as shown. An electrical connection is achieved upon sliding the antenna assembly 40 into place on the reduced outer diameter portion 42, which will engage the first electrical connector 47 into the second electrical connector 48. In the present example, the reduced outer diameter end portion 45 of the second tubular member 44 may then be inserted in the cylindrical dielectric housing 41 and coupled with the reduced outer diameter end portion 42 of the first tubular member 43 (e.g., they may be threadably coupled together). However, in other embodiments where the second tubular member 44 does not have the reduced outer diameter portion 45, the antenna assembly will slide onto the first tubular member 43, and the second tubular member is coupled to the reduced diameter portion 42 of the first tubular member. For example, the inner surface of the second tubular member 44 may have threads for engaging corresponding threads on the reduced outer diameter portion 42 of the first tubular member 43, or they may be coupled by other suitable connectors.

It should also be noted that more than one antenna assembly 40 may be positioned between the first tubular member 43 and the second tubular member 44 in the present embodiment, as well as the other embodiments discussed below. That is, one or more antenna assemblies 40 may be positioned on the reduced diameter portion 42 of the first tubular member 43, and if the second tubular member 44 also includes the reduced outer diameter portion 45, then one or more antenna assemblies may be positioned there as well.

In the present example, the first electrical connector 47 comprises a body portion 53 that is integrally formed or molded with the dielectric housing 41 (although it may be separately installed in some embodiments) and includes at least one electrode 54 carried by the body portion. Furthermore, a sealing ring(s) 55 is also associated with the removable modular antenna assembly. In the present example, the sealing ring 55 is carried by the body portion 54 to seal out water, mud, dirt, or other materials that could compromise the electrical connection to the resistivity processing circuitry 49. In some embodiments, a set screw or other locking device may also be used to securely couple the first and second connectors 47, 48 together, if desired.

A related method for making a wellbore apparatus is now described with reference to the flow diagram 60 of FIG. 7. Beginning at Block 61, the method illustratively includes providing the first and second tubular members 43, 44 to be joined together in end-to-end relation (Block 62). The method further includes removably positioning the cylindrical dielectric housing 41 of the removable modular antenna assembly 40 on the reduced outer diameter end portion 42 of the first tubular member, at Block 63. Furthermore, the first electrical connector 47 is coupled to the resistivity processing circuitry 49 (e.g., via the second electrical connector 48), at Block 64, and the first and second tubular members 43, 44 are joined together in end-to-end relation with the removable modular antenna assembly 40 carried by the reduced outer diameter end portion 42 of the first tubular member, at Block 65, which concludes the method illustrated in FIG. 6 (Block 66).

Figure 4:
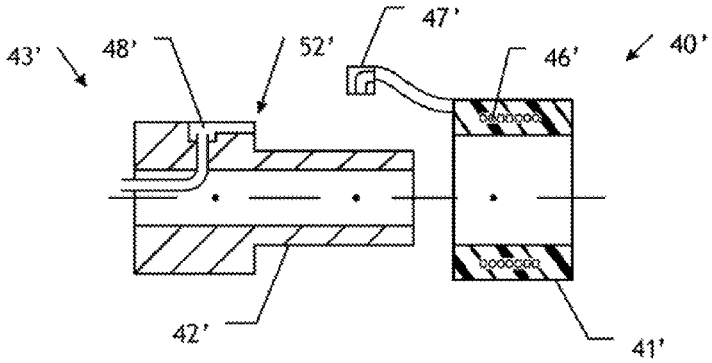
FIG. 4 is a schematic cross-sectional diagram of an embodiment of a removable modular antenna assembly and associated tubular member.

Turning now to FIG. 4, in accordance with another example embodiment the first tubular member 43' has a connector-receiving recess in an outer portion thereof adjacent the reduced outer diameter end portion 42', and the second electrical connector 48' is carried by the connector-receiving recess. Moreover, the first electrical connector 47' comprises a pigtail electrical connector to couple to the corresponding second electrical connector 48' in the connector-receiving recess on the outer portion of the first tubular member 43'. Here again, a seal or sealing ring may optionally be used to help prevent contaminants from compromising the electrical connection between the first electrical connector 47' and the second electrical connector 48'.

Figure 5:
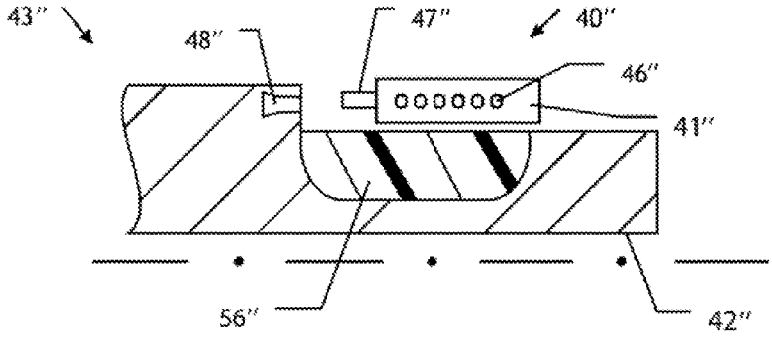
FIG. 5 is a schematic cross-sectional diagram of another embodiment of a removable modular antenna assembly and associated tubular member.

In accordance with another example embodiment shown in FIG. 5, the reduced outer diameter end portion 42" of the first tubular member 43" comprises a dielectric layer or region 56" adjacent the removable modular antenna assembly 40". More particularly, the dielectric layer is positioned beneath where the cylindrical dielectric body 41" is positioned when the first electrical connector 47" is plugged into the second electrical connector 48". This embodiment allows the first tubular member 43" to have a larger outer diameter along the reduced diameter portion 42" while providing desired depth for the electrical insulator under the antenna coil 46". In this embodiment, the cylindrical dielectric housing 41" is again slidably received on the reduced outer diameter end portion 42" of the first tubular member 43", as described above.

Figure 6:
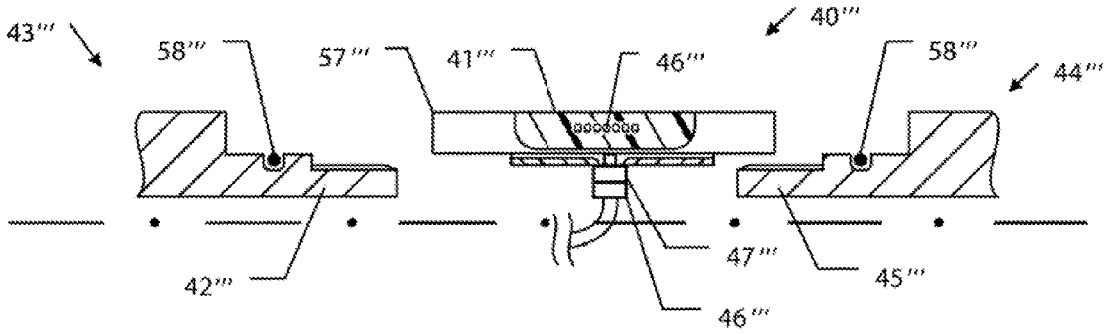
FIG. 6 is a schematic cross-sectional diagram of still another embodiment of a removable modular antenna assembly and associated tubular members.
Figure 7:
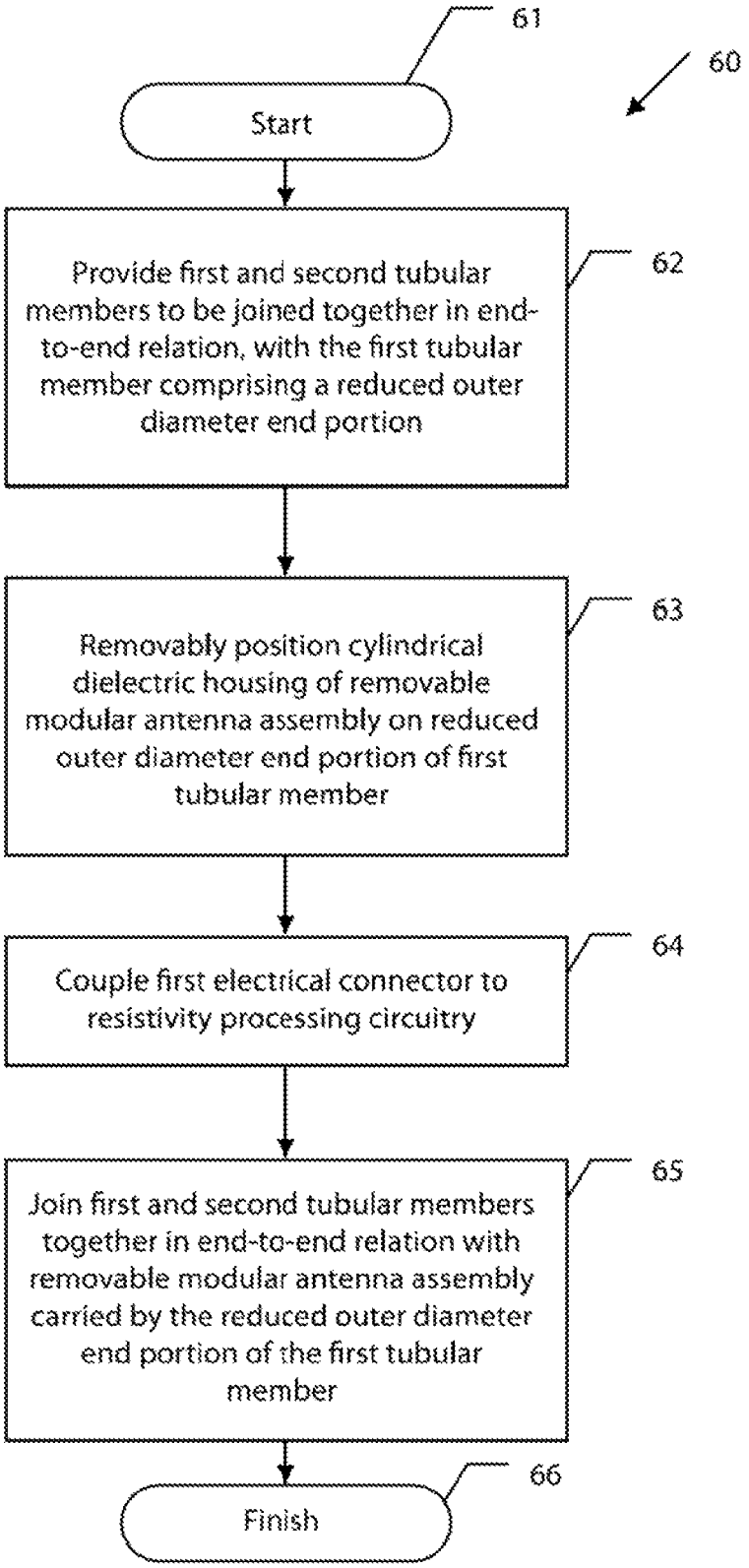
FIG. 7 is a flow diagram illustrating method aspects associated with the system of FIG. 1.

Turning now to FIG. 6, in still another example embodiment the second tubular member 44''' includes the reduced outer diameter end portion 45''', as noted above, and the removable modular antenna assembly 40''' further includes a coupler body 57''' carrying the cylindrical dielectric housing 41''' and threadably coupling the reduced outer diameter end portions 42''', 45''' of the first and second tubular members 43''', 44''' together, as shown. Here again, sealing rings 58''' may be included to promote a seal between the first and second tubular members 43''', 44''' and the coupler body 57''', if desired.

It will be appreciated that the above-described removable modular antenna assemblies may be installed and uninstalled on a downhole tubular (such as a housing or collar), removed, or replaced as desired. This may allow antennas to be readily replaced in the field when worn or damaged, rather than having to remove large drill collars or other tubular sections and send them offsite for service or re-fitting of permanent embedded antennas, for example. Additionally, the removable antenna assemblies allow pressure balancing, thus reducing size variation with pressure. In some embodiments, the antenna coil 46 may be mounted on a ceramic or polymer core, and then molded in a fluid resistant polymer or elastomer (e.g., rubber). Example dielectric material may include PEEK, SPS or other thermoplastic or thermoset, for example.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A wellbore apparatus comprising:

first and second tubular members, each of the first and the second tubular members comprising an end portion having a first outer diameter;

a removable modular antenna assembly comprising, a hollow cylindrical dielectric housing comprising an inner wall and an outer wall, the inner wall comprising an inner wall diameter larger than the first outer diameter, at least one antenna coil carried by said hollow cylindrical dielectric housing;

a dielectric material disposed around the at least one antenna coil and carried by said hollow cylindrical dielectric housing between the inner wall and the outer wall, wherein during operations of the wellbore apparatus the outer wall of the hollow cylindrical dielectric housing is exposed in a wellbore; and a first electrical connector coupled to said at least one antenna coil; and resistivity processing circuitry coupled to said first electrical connector to determine an electrical resistivity of a wellbore based upon said at least one antenna coil, wherein the first tubular member is removably inserted into the hollow cylindrical dielectric housing via a first opening of the hollow cylindrical dielectric housing and wherein the first tubular member is coupled to the second tubular member so that the first and the second tubular members are on a same axis and the end portions face each other.

2. The wellbore apparatus of claim 1 further comprising a second electrical connector coupled to said resistivity processing circuitry, carried by said first tubular member, and mating with said first electrical connector.

3. The wellbore apparatus of claim 2 wherein the end portion of said first tubular member defines a shoulder with adjacent portions of said first tubular member; and wherein said second electrical connector is carried by the shoulder.

4. The wellbore apparatus of claim 2 wherein said first tubular member has a connector-receiving recess in an outer portion thereof adjacent the end portion; and wherein said second electrical connector is carried by the connector-receiving recess.

5. The wellbore apparatus of claim 1 wherein said first connector comprises a body portion integrally formed with said dielectric housing and at least one electrode carried by said body portion.

6. The wellbore apparatus of claim 1 comprising a second removable modular antenna assembly, wherein the second tubular member is removably inserted into a second hollow cylindrical dielectric housing of the second removable modular antenna assembly via a second opening of the second hollow cylindrical dielectric housing.

7. The wellbore apparatus of claim 1 wherein the diameter end portion of said first tubular member comprises a dielectric layer adjacent said removable modular antenna assembly.

8. The wellbore apparatus of claim 1 wherein said removable modular antenna assembly further comprises a coupler body carrying said cylindrical dielectric housing and threadably coupling the end portions of said first and second tubular members together.

9. The wellbore apparatus of claim 1 wherein said dielectric housing is slidably received on end portion of said first tubular member.

10. The wellbore apparatus of claim 1 further comprising at least one sealing ring associated with said removable modular antenna assembly.

11. The wellbore apparatus of claim 1 wherein said resistivity processing circuitry comprises a controller and at least one of a transmitter and receiver coupled thereto.

12. The wellbore drilling apparatus of claim 1 wherein said first electrical connector comprises a pigtail electrical connector.

13. A method for making a wellbore apparatus comprising:

providing first and second tubular members to be joined together, with the first tubular member comprising a first end portion having a first outer diameter;

removably positioning a hollow cylindrical dielectric housing of a removable modular antenna assembly on the first end portion of the first tubular member, the removable modular antenna assembly comprising at least one antenna coil carried by the hollow cylindrical dielectric housing, and a first electrical connector coupled to the at least one antenna coil, the hollow cylindrical dielectric housing comprising an inner wall and an outer wall, the inner wall comprising an inner wall diameter larger than the first outer diameter;

disposing a dielectric material around the at least one antenna coil and between the inner wall and the outer wall of the hollow cylindrical dielectric housing, wherein during drill operations of the wellbore apparatus the outer wall of the hollow cylindrical dielectric housing is exposed in a wellbore;

coupling the first electrical connector to resistivity processing circuitry; and joining the first and second tubular members together with the removable modular antenna assembly carried by the first end portion of the first tubular member, wherein the first tubular member is removably inserted into the hollow cylindrical dielectric housing via a first opening of the hollow cylindrical dielectric housing and wherein the first tubular member is coupled to the second tubular member so that the first and the second tubular members are on a same axis and the first end portion faces a second end portion of the second tubular member, wherein the second end portion comprises the first outer diameter.

14. The method of claim 13 wherein coupling comprises coupling the first electrical connector to resistivity processing circuitry via a second electrical connector coupled carried by the first tubular member and mating with the first electrical connector.

15. The method of claim 14 wherein the first end portion of the first tubular member defines a shoulder with adjacent portions of the first tubular member; and wherein the second electrical connector is carried by the shoulder.

16. The method of claim 14 wherein the first tubular member has a connector-receiving recess in an outer portion thereof adjacent the first end portion; and wherein the second electrical connector is carried by the connector-receiving recess.

17. The method of claim 13 wherein the first connector comprises a body portion integrally formed with the dielectric housing and at least one electrode carried by the body portion.

18. The method of claim 13 wherein the first electrical connector comprises a pigtail electrical connector.

19. The method of claim 13 wherein the removable modular antenna assembly further comprises a coupler body carrying the hollow cylindrical dielectric housing; and wherein joining comprises threadably coupling the first end portion and second end portion of the first and second tubular members together with the coupler body.

20. The method of claim 13 wherein joining comprises sliding the dielectric housing on the reduced outer diameter end portion of the first tubular member.

* * * * *